US005234242A

United States Patent [19]

Mizuguchi et al.

[11] Patent Number: 5,234,242

[45] Date of Patent: Aug. 10, 1993

[54] SUBMARINE CABLE GRAPNEL

[75] Inventors: Takashi Mizuguchi, Haebaru; Yoshihiro Ejiri, Higashikurume; Kazuomi Yamamura, Yokohama; Kikuo Shirai, Chofu, all of Japan

[73] Assignee: Kokusai Denshin Denwa Kabushiki Kaisha, Tokyo, Japan

[21] Appl. No.: 686,777

[22] Filed: Apr. 17, 1991

[30] Foreign Application Priority Data

| | | | |
|---|---|---|---|
| Apr. 19, 1990 | [JP] | Japan | 2-101600 |
| Apr. 19, 1990 | [JP] | Japan | 2-101601 |
| Apr. 23, 1990 | [JP] | Japan | 2-105223 |
| Jul. 30, 1990 | [JP] | Japan | 2-199048 |

[51] Int. Cl.[5] ..... B66C 1/10

[52] U.S. Cl. ..... 294/66.1; 114/221 R

[58] Field of Search ..... 294/66.1, 82.1, 82.13; 114/51, 221 A, 221 R; 405/158, 159, 162, 164, 173

[56] References Cited

U.S. PATENT DOCUMENTS

| | | | |
|---|---|---|---|
| 3,097,874 | 7/1963 | Brockbank | 294/66.1 |
| 3,129,030 | 4/1964 | Brockbank et al. | 294/66.1 |
| 3,516,158 | 6/1970 | Ferrentino | 294/66.1 X |
| 3,765,185 | 10/1973 | Peck et al. | 294/66.1 X |
| 3,898,852 | 8/1975 | Ezoe et al. | 405/164 |
| 3,990,255 | 11/1976 | Cosier et al. | 294/66.1 X |
| 4,761,649 | 8/1988 | Matsuzaki et al. | 294/66.1 X |
| 4,768,820 | 9/1988 | Barone | 294/66.1 |
| 4,805,547 | 2/1989 | Matsuzaki et al. | 294/66.1 X |

*Primary Examiner*—David M. Mitchell
*Assistant Examiner*—Dean J. Kramer
*Attorney, Agent, or Firm*—Emmanuel J. Lobato; Robert E. Burns

[57] ABSTRACT

There is disclosed a submarine cable grapnel which is tied to the two rope of a cable ship and is dragged on the bottom of the sea, one grappling unit and at least one attitude stabilizer is connected while this assembly is connected at one end the two rope of the cable ship and at the other end a chain. In this instance, front and rear coupling portions of the grappling element and the attitude stabilizer are positioned so that the center of gravity of each element under the water stays nearer the seabed than a straight line joining the coupling centers of the coupling portions of the elements when the grapnel lands in the normal attitude on the bottom of the sea.

15 Claims, 8 Drawing Sheets

FIG. 2A
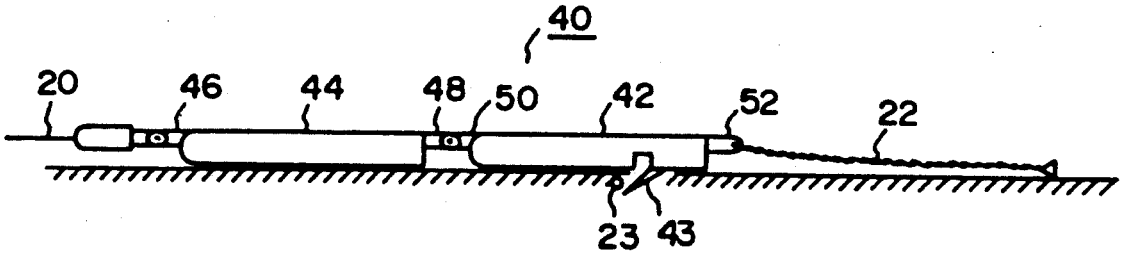
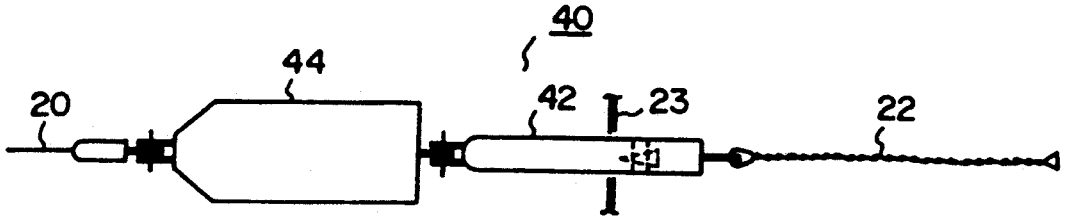
FIG. 2B
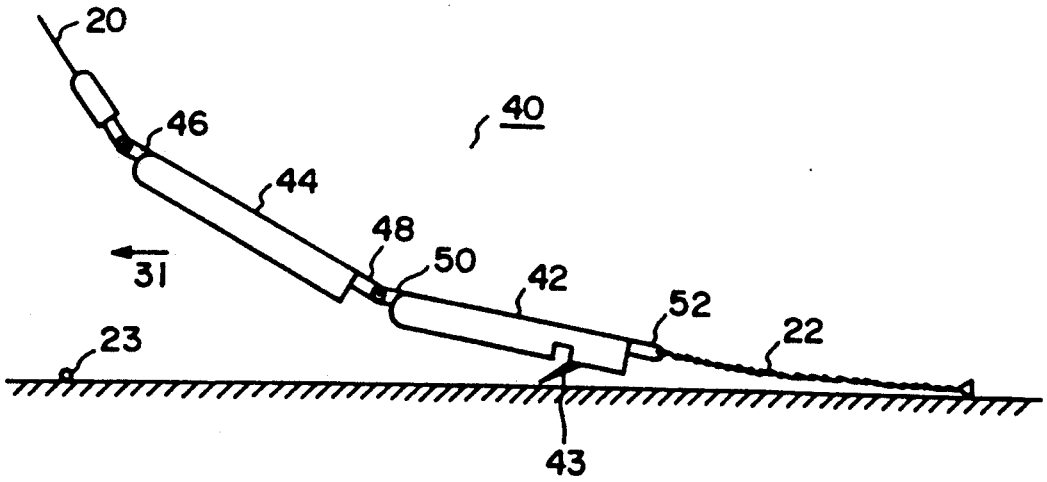
FIG. 3

FIG. 4A
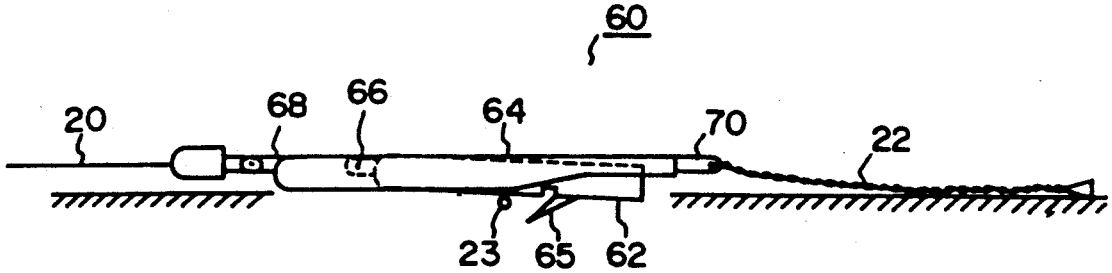
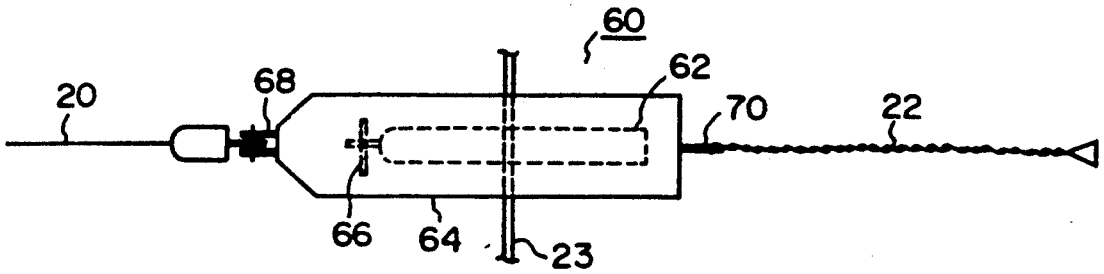
FIG. 4B
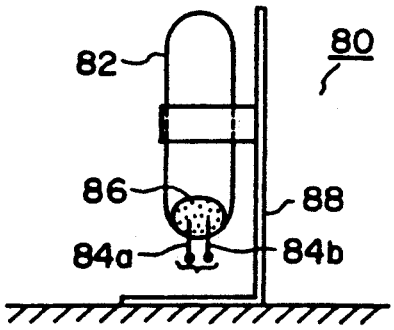
FIG. 5A
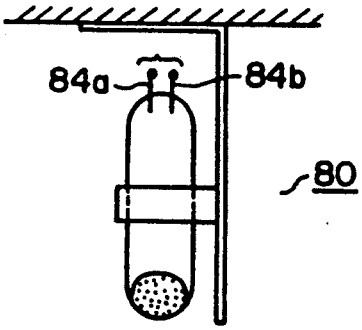
FIG. 5B

FIG. 10
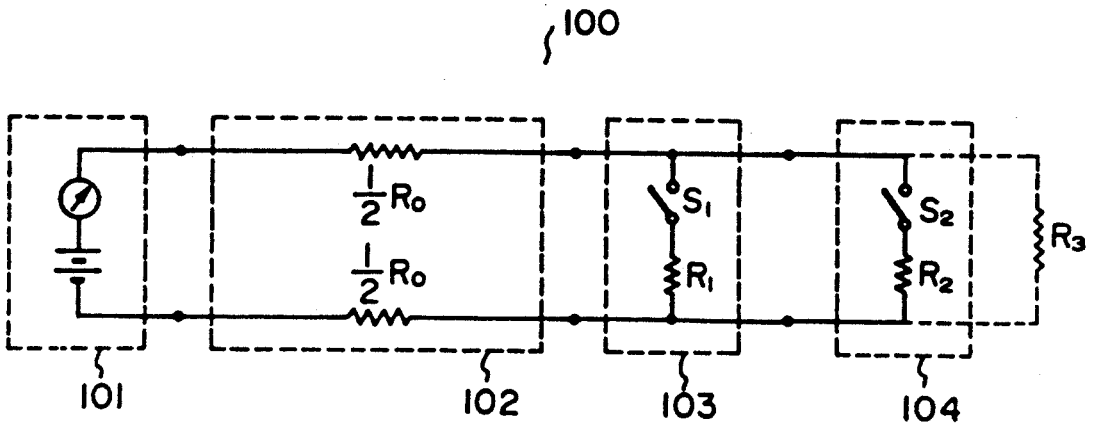
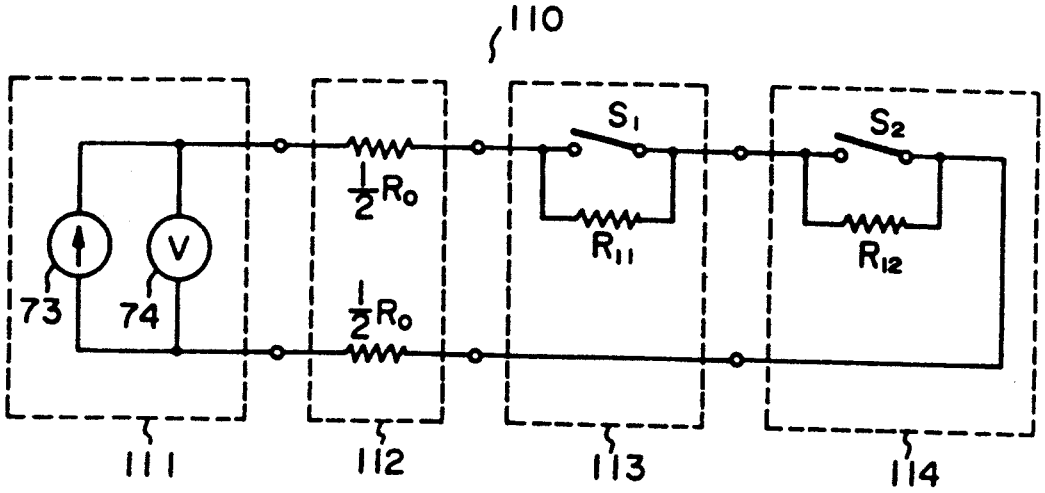
FIG. 11

SUBMARINE CABLE GRAPNEL

BACKGROUND OF THE INVENTION

The present invention relates to a submarine cable grapnel for grappling a submarine cable on the bottom of the sea for recovery onto a cable ship.

In case of recovering a failing submarine cable, a cable grapnel is paid out from a cable ship down to the bottom of the sea and is dragged in a direction substantially perpendicular to that in which the cable is laid on the seabed, and the failing cable grappled by the grapnel is pulled up onto the cable ship for repair.

The conventional submarine cable grapnel poses the following problems when using the grappling unit singly. First, when the cable grapnel is brought down to the bottom of the sea, the grappling unit often spins and hence cannot land on the seabed in a normal attitude in which the grappling hook digs up the seabed. Second, when the grapnel is dragged, the grappling hook often rotates on the seabed and cannot maintain its normal attitude in which the hook digs up the seabed.

One solution that has been proposed to solve these problems is to connect four grappling units with their hooks spaced apart an angular distance of 90° about the axis of grapnel. However, this structure calls for four grappling units and hence is at least four times as expensive as one grappling unit, and maintenance and repair work of the grapnel 10 also becomes four-fold accordingly.

SUMMARY OF THE INVENTION

It is therefore an object of the present invention to provide a submarine cable grapnel which is free from the above-mentioned defects of the prior art, low-cost and easy to handle.

According to an aspect of the present invention, in the submarine cable grapnel which is tied to the two rope of a cable ship and is dragged on the bottom of the sea, one grappling unit and at least one attitude stabilizer is connected while this assembly is connected at one end the two rope of the cable ship and at the other end loading means (such as a chain). In this instance, front and rear coupling portions of the respective elements (the grappling element and the attitude stabilizer) are positioned so that the center of gravity of each element under the water stays nearer the seabed than a straight line joining the coupling centers of the coupling portions of the elements when the grapnel lands in the normal attitude on the bottom of the sea.

According to another aspect of the present invention, the submarine cable grapnel, which is tied to the two rope of a cable ship and is dragged on the bottom of the sea, is composed of an attitude stabilizer and a grappling unit formed as a unitary structure with each other, and the grapnel is connected at one end to the tow rope of the cable ship and at the other end a load (such as a chain). In this instance, front and rear coupling portions of the grapnel are positioned so that the center of its gravity stays nearer the seabed than a straight line joining the coupling centers of the coupling portions when the grapnel lands on the seabed in the normal attitude.

BRIEF DESCRIPTION OF THE DRAWINGS

The present invention will be described in detail below in comparison with prior art with reference to accompanying drawings, in which:

FIGS. 2A and 2B are a side view and a plan view schematically illustrating a submarine cable grapnel according to a first embodiment of the present invention;

FIG. 3 is a side view explanatory of laying the grapnel of the present invention on the bottom of the sea;

FIGS. 4A and 4B are a side view and a plan view schematically illustrating a second embodiment of the present invention;

FIGS. 5A and 5B are side views illustrating the principal part of a third embodiment of the present invention;

FIG. 10 is a circuit diagram of a grapnel signal system of the submarine cable grapnel for use in the above-mentioned embodiments; and FIG. 11 is a circuit diagram illustrating another example of the grapnel signal system employed in the present invention.

DETAILED DESCRIPTION

To make differences between prior art and the present invention clear, an example of prior art will first be described.

Figure 1:
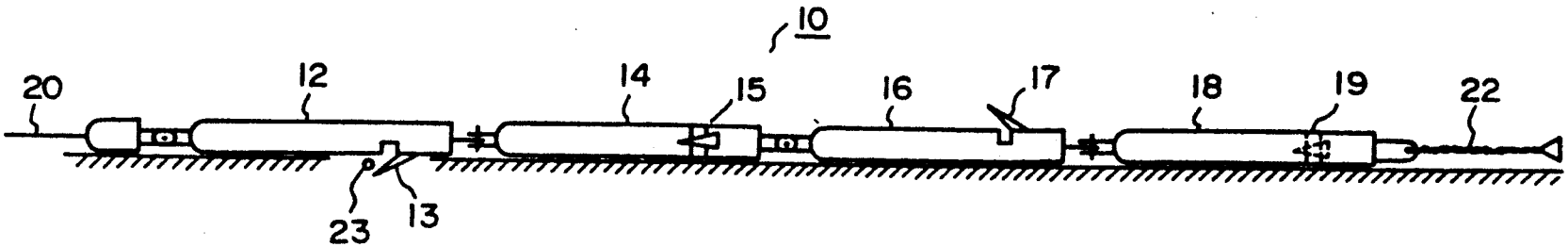
FIG. 1 PRIOR ART
FIG. 1 is a side view illustrating construction of a conventional submarine cable grapnel.

FIG. 1 is a diagram showing the construction of a conventional submarine cable grapnel, which is indicated generally by 10. As depicted in FIG. 1, the prior art cable grapnel 10 has four grappling units 12, 14, 16 and 18 tied in a line with their hooks 13, 15, 17 and 19 each disposed at an angle of 90° to the adjacent hook. The cable grapnel 10 is dragged via a tow rope 20 by a cable ship in a direction substantially perpendicular to the direction in which a submarine cable 23 is laid on the bottom of the sea. The Grapnel 10 grapples the submarine cable 23 with the hook, for example, 13 as shown.

A reason for which the four grappling units 12, 14, 16 and 18 are tied in a line with their hooks 13, 15, 17 and 19 each disposed at an angle of 90° to the adjacent hook is to ensure that when the grapnel is brought down tot he seabed and is dragged, the grappling hook of any one of the four grappling units 12, 14, 16 and 18 digs up the seabed for grappling the submarine cable 23. A chain 22 is to provide back tension for stable traveling of the grappling unit 18 on the bottom of the sea. However, this calls for high cost in structure and maintenance.

The present invention will hereinafter be described in detail with reference to the accompanying drawings.

EMBODIMENT 1

FIGS. 2A and 2B are a side view and a plan view schematically illustrating a submarine cable grapnel according to a first embodiment of the present invention. The grapnel of this embodiment indicated generally by 40, comprises: a two rope 20 for dragging the grapnel by a cable ship; an attitude stabilizer 44 made of steel or the like, which is tied to the rope 20; one grappling unit 42 connected to the stabilizer 44; and a chain 22 connected to the grappling unit 42, for applying a load thereto.

In this case, coupling portions 46 and 48 of the attitude stabilizer 44 are provided so that a straight line joining the coupling portions 46 and 48 stays above the center of gravity of the stabilizer 44. Similarly, coupling portions 50 and 52 of the grappling unit 42 are also provided so that a straing line joining them stays above the center of gravity of the grappling unit 42. It will be more effective and more preferable to form the stabilizer 44 and the grappling unit 42 so that their centers of gravity further lower toward the bottom of the sea.

FIG. 3 is a side view of the grapnel 40, for explaining how it lands on the bottom of the sea. In FIG. 3 the rear end portion of the chain 22 is already on the seabed, the two rope 20 is paid out, and at the same time, the cable ship is steered to make headway at slow speed in the direction indicated by the arrow 31, thus applying tension to the rope 20. In this case, since the coupling portions 46, 48 and 50, 52 are provided to be higher than the centers of gravity of the attitude stabilizer 44 and the grappling unit 42, respectively, the grapnel 40 can be landed on the seabed in such a posture that a grappling hook 43 digs up the seabed while being dragged thereon. While this embodiment is shown to use only one attitude stabilizer 44, the grapnel 40 will be further stabilized, if two or more stabilizers are employed. The positions of the grappling unit 42 and the attitude stabilizer 44 in FIG. 2 may also be reversed, or another attitude stabilizer 44 may also be connected to the rear end of the grappling unit 42.

EMBODIMENT 2

FIG. 4 illustrates a second embodiment of the present invention. The submarine cable grapnel, indicated generally by 60, has its grappling unit 62 mounted on the underside of an attitude stabilizer 64 by means of a pin 66. The grappling unit 62 is pivotally secured to the pin 66 in such a manner that a grappling hook 65 may turn about the pin 66 and lower from its uppermost position parallel to the horizontal top of the stabilizer 64 to a position low enough to grapple the submarine cable 23. Connecting portions 68 and 70 of the two rope 20 and the chain 22 are provided such that a straight line joining the portions 68 and 70 stays to be higher than the center of gravity of the grapnel, this ensuring that the grapnel 60 lands in the normal attitude on the bottom of the sea.

EMBODIMENT 3

FIG. 5 illustrates the principal part of a third embodiment of the present invention, in which an attitude sensor 80 is mounted on the above-mentioned attitude stabilizer or grappling unit and means is provided for transmitting the output signal of the attitude sensor 80 to the cable ship via a signal lien provided in the tow rope or underwater acoustic means. With this structure, if the cable grapnel fails to assume its normal attitude on the bottom of the sea, it is pulled up from the seabed and then landed again thereon in the normal attitude this ensuring normal landing of the grapnel on the bottom of the sea. In FIGS. 5A and 5B reference numeral 82 denotes a glass envelope containing mercury 86 described later on, 84*a* and 84*b* signal lines interconnecting the attitude sensor 80 and the cable ship (i.e. a monitoring section), 86 a conductive substance which is movable according to the attitude of landing of the cable grapnel on the seabed, such as mercury, and 88 a bracket fixed to the cable grapnel. FIG. 5A shows the normal landing of the grapnel on the bottom of the sea, and in this instance, since the signal lines 84*a* and 84*b* are electrically connected via the mercury 86, the normal landing of the grapnel can be detected on the cable ship via the signal lines 84*a* and 84*b*. FIG. 5B shows the abnormal landing of the grapnel, and in this case the signal lines 84*a* and 84*b* are mutually disconnected.

EMBODIMENT 4

Figure 6A:
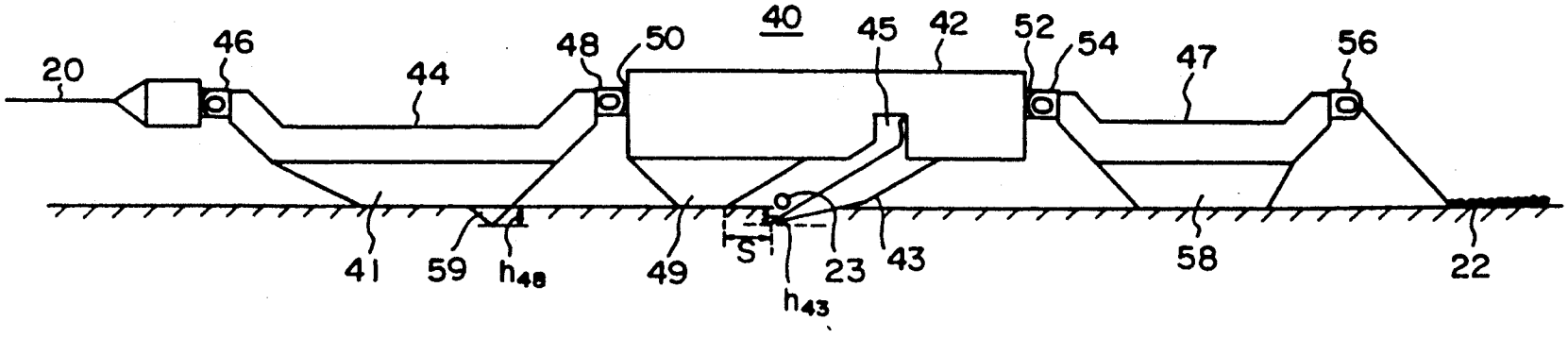
FIGS. 6A and 6B are a side view and a plan view schematically illustrating the submarine cable grapnel in accordance with a fourth embodiment of the present invention.
Figure 6B:
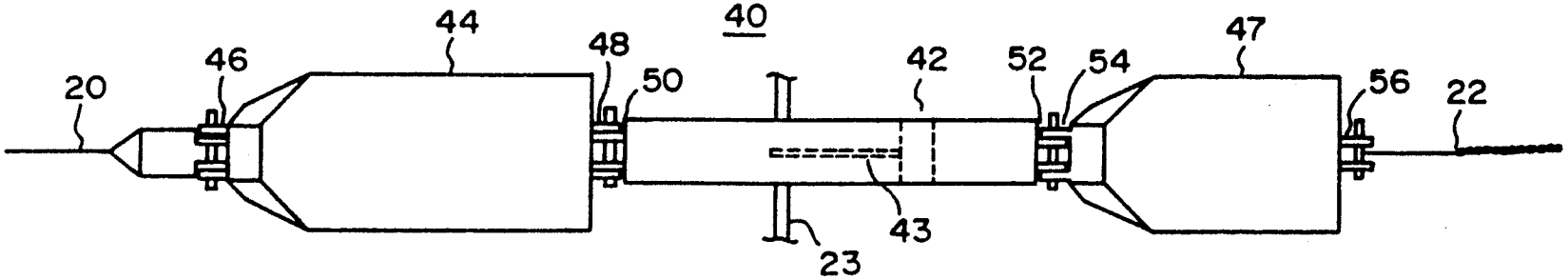

FIGS. 6A and 6B are a side view and a plan view schematically illustrating the submarine cable grapnel in accordance with a fourth embodiment of the present invention.

In FIG. 6A the cable grapnel, identified generally by 40, includes: the two rope 20 for dragging the grapnel by a cable ship; the attitude stabilizer 44 made of steel or the like and connected to the tow rope 20; one grappling unit 42 connected to the attitude stabilizer 44; a rear attitude stabilizer 47 connected to the grappling unit 42; and a chain 22 connected to the rear attitude stabilizer 47, for applying thereto a load. The attitude stabilizer 44 has a pedestal 41 and a stone remover 59. The grappling unit 42 has a pedestal 49 and a grappling hook 43. The rear attitude stabilizer 47 has a pedestal 58.

The attitude stabilizer 44 has its coupling portion 46 and 48 provided so that a straight line joining them lies above the center of gravity of the stabilizer 44. The grappling unit 42 also has its coupling portions 50 and 52 provided so that a line joining them lies above the center of gravity of the grappling unit 42. Further, the rear attitude stabilizer 47 also has its coupling portions 54 and 56 provided so that a line joining them lies above the center of gravity of the stabilizer 47. It will be more effective that the stabilizer 44, the grappling unit 42 and the rear stabilizer 47 are configured to have their centers of gravity lying nearer the undersides of their pedestals 41, 49 and 58.

The pedestals 41, 49 and 58 and the stone remover 59 are used to prevent that earth and sand from the dragging of the cable grapnel 40 on the seabed enter into a cable holding and cutting part 45 of the grappling unit 42.

In a case where the bottom of the sea is covered with sand, the pedestals 41, 49 and 58 need to be about 12 cm in height for preventing earth and sand from entering into the cable holding and cutting part 45 of the grappling unit 42. The front angle of the attitude stabilizer 44 in the direction in which the grapnel 40 is dragged may preferably be 30° or less to prevent the submarine cable 23 from catching on the stabilizer 44. The pedestals 41, 49 and 58 have to be of the same height so as to stabilize the attitude of the grapnel 40 during its landing and dragging on the seabed.

To ensure grappling of the cable 23 and to reduce the amount of earth and sand resulting from dragging of the grapnel 40, it is effective that the angle of grappling hook 43 to the grappling unit 42 is around 30°. While the grappling hook 43 was of about 1.5 cm in thickness in our experiment, the thinner, the better, if its mechanical strength permits.

The angle of the rear slope of the pedestal 49 opposite the grappling hook 43 may preferably be the same as the angle of the hook 43 to the grappling unit 42 from the viewpoint of preventing earth and soil from entering into the cable holding and cutting part 45 of the grappling unit 42. It is desirable that the front angle of the pedestal 49 in the direction of dragging the grapnel 40 be approximately 30°, from the viewpoint of preventing the submarine cable 23 from catching on the pedestal 49, but when the above-said front angle is chosen greater than 30° in relation to the length of the grappling unit 42, the front lower marginal portion of the pedestal 49 must be rounded. The pedestal 58 of the rear stabilizer 47 is identical in configuration with the pedestal 41 of the stabilizer 44. The height $h_{43}$ of the grappling hook 43 with respect to the pedestal 49 of the grappling unit 42 is required to be 1.5 to 2.5 times larger than the maximum diameter of the cable 23 to be grappled, so as to ensure the grappling of the cable and to minimize the amount of earth and soil to be removed. It is preferable that the spacing S between the trailing edge of the pedestal 49 facing the grappling hook 43 and the tip end portion of the latter 43 in the direction of dragging the grapnel 40 be three to five times greater than the maximum diameter of the submarine cable 23.

By preparing several sets of pedestals 41, 49 and 58 of different heights, formed detachable from the stabilizer 44, the grappling unit 42 and the stabilizer 47, respectively, and by selectively employing them according to the soil quality of the seabed, it is possible to more effectively prevent earth and soil from entering into the cable holding and cutting part 45 of the grappling unit 42. Of course, the height $h_{43}$ of the grappling hook 43 is provided in accordance with the height of the pedestal 49.

The stone remover 59 is a means by which pebbles in the seabed, lying on the line of dragging the grappling unit 42 and having such sizes and shapes as to enter into the gap between the pedestal 49 and the grappling hook 43, are removed from the above-said line of dragging the grappling unit 42. It is effective for this purpose that the height $h_{48}$ and the width of the stone remover 59 are the same as those of the grappling hook 43.

EMBODIMENT 5

Figure 7:
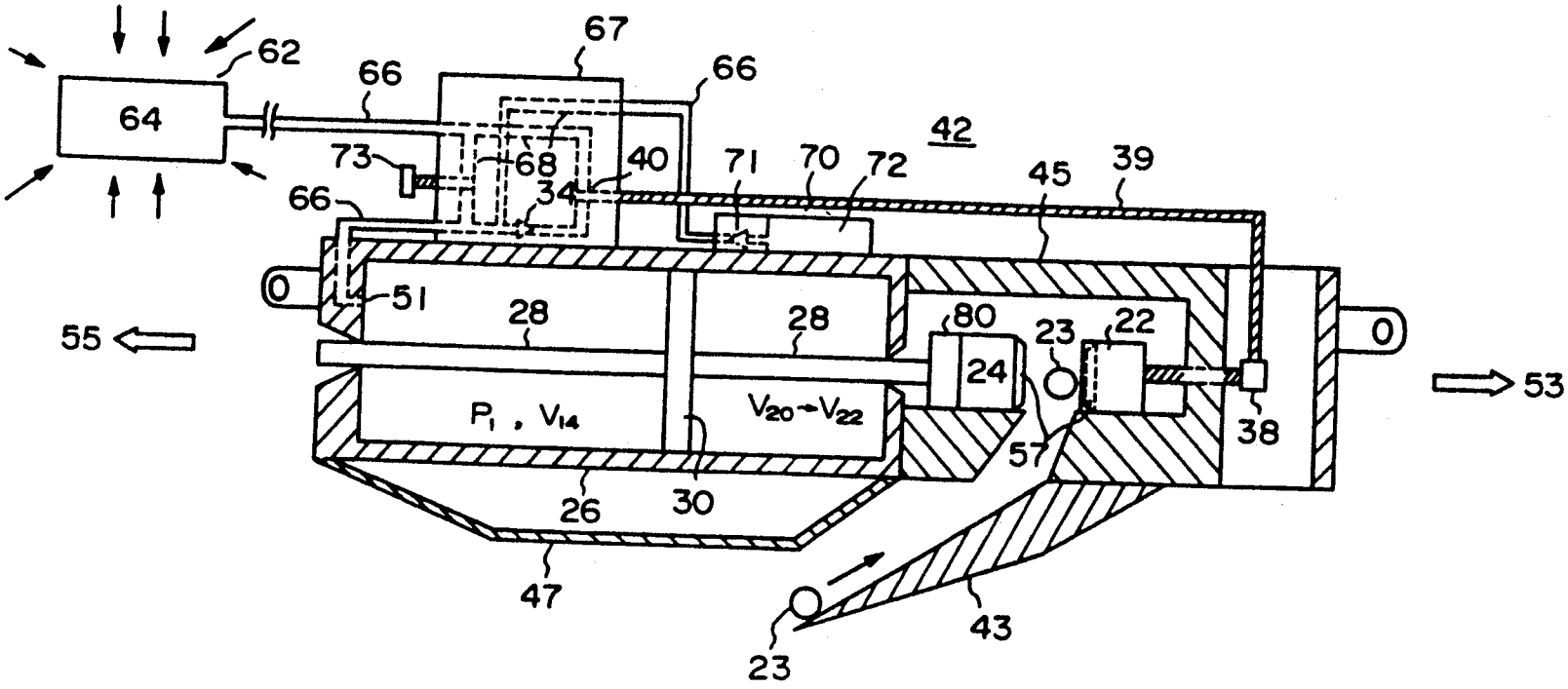
FIG. 7 is a section of a grappling unit illustrating as a fifth embodiment of the present invention.

FIG. 7 illustrates in section the grappling unit 42 which utilizes sea water pressure in accordance with a fifth embodiment of the present invention.

The grappling unit 42 is made up principally of a cylinder 26, a piston rod 28 passing therethrough, a sliding disk 30 affixed to the piston rod 28 and dividing the interior of the cylinder 26 into a high-pressure compartment and a low-pressure compartment, a hydraulic oil tank 62 storing hydraulic oil 64 for pressurizing the sliding disk 30, a pipe 66 joining the hydraulic oil tan k 62 and the cylinder 26, a fluid branching unit 67 provided in the pipe 66 between the hydraulic oil tank 62 and the cylinder 26, for controlling the flow of the hydraulic oil 64, a cylinder internal pressure controller 70, and a stroke adjustment means 80. The hydraulic oil tank 62 is a container which is freely compressible and hence is deformable by the external sea water pressure, such as a container made of rubber or similar elastic material, or a container formed by bellows.

The operation of this embodiment will hereinbelow be described.

As the grappling unit 42 is dragged on the seabed in the direction indicated by the arrow 55, the submarine cable 23 is grappled by the grappling hook 43 and is then brought up into the gap between cable holders 24 and 22 in the cable holding and cutting part 45 of the grappling unit 42. Then, when the pressure of the thus grappled submarine cable 23 to the cable holder 22 exceeds a certain value as the grappling unit 42 is further dragged in the direction of the arrow 55, a rod 39 connected to a cable grappling sensor 38 moves in the direction indicated by the arrow 53, by which a passage 68 in the fluid branching unit 67 between the hydraulic oil tank 62 and the cylinder 26 is opened at a position indicated by 40. Consequently, the hydraulic oil 64 flows into the cylinder 26 through its inlet port 51 owing to the sea water pressure and urges the sliding disk 30 in the direction of the arrow 53. Thus, the cable holder 24 attached to the piston rod 28 moves in the direction of the arrow 53 and presses the cable 23 against the other cable holder 22 to cut it by cutting edges 57 provided on the cable holders 24 and 22.

In this instance, pressure F which acts on the cable holder 24 is given by the following expression:

$$F=P_1S_1+P_hS_2-P_2S_1-P_hS_2=(P_1-P_2)S_1 \quad (1)$$

Thus, the pressure F assumes a constant value. In the above, $P_1$ is the pressure in the high-pressure conpartment of the cylinder 26 (on the left-hand side of the sliding disk 30), which pressure is equal to that at the bottom of the sea; $P_2$ is the pressure in the low-pressure compartment of the cylinder 26 (on the right-hand side of the sliding disk 30), which pressure is equal to that when air of a volume $V_{20}$ is compressed to a volume $V_{22}$ at a pressure of 1 atm ($=1$ atm$\times V_{20}/V_{22}$); $S_1$ is the difference between the area of the circle of the disk 30 and the sectional area $S_2$ of the piston rod 28; $S_2$ is the sectional area of the piston rod 28; and $P_h$ is the external sea water pressure to the grappling unit 42.

For raising the grappling unit 42 from the bottom of the sea to recover the cable 23 held and cut by the cable holders 22 and 24 onto the cable ship, it is necessary that a check valve 34 in the branching unit 67 be activated to prevent a drop of pressure in the cylinder 26. At this time, the passage 68 from the check valve 34 to the hydraulic oil tank 62 is cut off by a check valve 73 in the branching unit 67. When a gap forms between the cable holders 22 and 24 owing to the compression, deformation or the like of the cable 23 held therebetween during pulling up of the grappling unit 42 onto the cable ship, the cable holder 24 is urged against the counterpart 22 to grip the cable 23 therebetween and the volume $V_{14}$ of the high-pressure compartment of the cylinder 26, filled with the hydraulic oil 64, increases by $\Delta V$. Letting $P_{14}$ represent the presure at which the volume of the hydraulic oil of pressure $P_1$ increases to $V_{14}+\Delta V$, the following expression holds:

$$(P_1-P_{14})\theta=\Delta V/V_{14} \quad (2)$$

where $\theta$ is the compressibility of the hydraulic oil 64. The volumes $V_{14}$ and $\Delta V$ are given as follows:

$$V_{14}=S_1\ \text{cm}^2\times L_1\ \text{cm} \quad (3)$$

$$\Delta V=S_1\ \text{cm}^2\times \Delta L\ \text{cm} \quad (4).$$

From Expressions 2 through 4 the pressure $P_{14}$ is obtained as follows:

$$P_{14}=P_1-\frac{\Delta V}{\theta V_{14}}=P_1-\frac{\Delta L}{\theta L_1} \quad (5)$$

Now, consider the recovery of the cable 23 from the deep seabed of 5,000 m. The pressure $P_1$ is about 500 atm in this instance. Assuming that the compressibility $\theta$ of the hydraulic oil is $0.6\times10-4$ atm, $L_1$ is 20 cm and $\Delta L$ is 0.1 cm, the pressure $P_{14}$ is 417 atm as given follows:

$$P_{14} = 500 - \frac{0.1/20}{0.6 \times 10 - 4} = 417 \text{ (atm)} \quad (6)$$

From the above it appears that even if the cable holder 24 is pushed forward during the raising of the cable, the compression characteristic of the hydraulic oil effectively acts under the condition of as high a pressure as several hundreds of atmospheres, preventing an appreciable decrease in the inner pressure of the cylinder 26, i.e. preventing the cable 23 from falling out of the cable holding and cutting part 45.

A first feature of Embodiment 5 utilizes, for holding and cutting the cable 23, the hydraulic oil 64 stored in the tank 62, instead of flowing seawater directly into the cylinder 26. This precludes the possibility of earth and soil on the seabed entering into the cylinder 26, and hence prevents that a watertight sliding mechanism of the sliding disk 30 slidably received in the cylinder 26 is worn away by such earth and soil. Thus, the cylinder 26 is essentially free from maintenance.

A second feature of Embodiment 5 resides in the construction in which the piston rod 28 extends in the cylinder 26 along the lengthwise direction thereof and projects out of its both end faces so that the piston rod 28 receives seawater pressure at both ends thereof.

The piston rod 28 possesses a function by which the pressure of the hydraulic oil 64 having once flowed into the cylinder 26, i.e. the pressure at the depth of water where the hydraulic oil 64 flowed into the cylinder 26, is maintained constant without being affected by a change in the outside pressure. This also prevents crushing of the cable 23 held between the cable holders 22 and 24.

Letting F represent the pressure of the cable holder 24 on the cable 23 in a case where the piston rod 28 passes through the both end faces of the cylinder 26 of the grappling unit 42 (Expression (1) and letting F' represent the pressure of the cable holder 24 on the cable 23 in a case where the piston rod 28 passes through only one end face of the cylinder 26 (that is, where the piston rod 28 is provided only on the right-hand side of the disk 30 and is omitted on the left-hand side thereof in FIG. 7), the pressure F' is expressed as follows:

$$F = P_1(S_1 + S_2) - P_2S_1 - P_hS_2 \quad (7).$$

Since $P_h = P_1$, the pressure F' when the grappling unit 42 is on the seabed is given as follows:

$$\begin{aligned} F &= P_1(S_1 - S_2) - P_2S_1 - P_1S_2 \\ &= (P_1 - P_2)S_1 \end{aligned} \quad (8)$$

This is the same as Expression (1), but as the grappling unit 42 is pulled up from the bottom of the sea, its outside hydraulic pressure $P_h$ varies with the depth of water, and since $P_h$ is equal to 1 atm, the pressure F' on the sea surface is given as follows:

$$\begin{aligned} F &= P_1(S_1 + S_2) - P_2S_1 - S_2 \\ &= (P_1 - P_2)S_1 + P_1S_2 - S_2 \end{aligned} \quad (9)$$

When the piston rod 28 projects out of only one end face of the cylinder 26, the sectional area $S_2$ of the rod 28 is small, and if its influence is ignored, then the pressure F' is given as follows:

$$F = (P_1 - P_2)S_1 + P_1S_2 \quad (10).$$

As will be seen from Expressions (1), (8) and (10), the pressure F of the cable holder 24 on the cable 23 is free from the influence of the outside hydraulic pressure on the grappling unit 42 and remains unchanged in a case where the piston rod 28 projects out of the both end faces of the cylinder 26.

On the other hand, the cylinder of the conventional grappling unit has no piston rod on the high-pressure side (i.e. on the left-hand side) of the sliding disk, so that as the grappling unit is lifted up from the bottom of the sea, the pressure F' of the cable holder 24 gradually increases and finally reaches its maximum value when the grappling unit 42 is brought up to the surface of the sea. Consequently, the cable holder 24 pressurizes the cable 23 more than necessary and damages it and, in some cases, cuts it off before it is pulled up onto the cable ship. This is of prime importance in designing the cylinder 26.

For instance, at a depth of 6,000 m the pressure $P_1$ is about 600 kg/cm$^2$, and if $V_{20}/V_{22}$ is assumed to be 3, then the pressure $P_2$ is about 3 kg/cm$^2$. Assuming that the areas $S_1$ and $S_2$ are 40 and 7 cm$^2$, respectively, the pressure F is around 24 tons. Similarly, the pressure F' on the surface of the sea is 28 tons; consequently, there is the possibility of the cable 23 held between the cable holders 24 and 22 being crushed or cut off.

A third feature of Embodiment 5 lies in the provision of the cylinder internal pressure controller 70, which will be described below with reference to FIG. 7.

The cylinder internal pressure controller 70 is provided by which when the hydraulic oil 64 introduced into the cylinder 26 is thermally expanded by a temperature rise, the expanded hydraulic oil 64 is absorbed to maintain the internal pressure of the cylinder 26 substantially constant.

In general, water temperature on the bottom of the sea is as low as approximately 0° C., and it is considered that the temperature in the cylinder 26 rises as much as tens of degrees centigrade when the submarine cable grapnel is brought up to the surface of the sea or onto the cable ship. In this instance, the liquid (i.e. the hydraulic oil 64) in the cylinder 26 thermally expands and raises the internal pressure of the cylinder 26, with the result that the cable 23 gripped between the cable holders 22 and 24 is further subjected to an unnecessary pressure and is sometime crushed or the mechanism of the cylinder 26 is adversely affected. This can be avoided by the cylinder internal pressure controller 70.

The cylinder internal pressure controller 70 is composed of a safety valve 71 which opens when the internal pressure of the cylinder 26 exceeds a predetermined value, and a liquid reservoir 72 which has a space for receiving a part of the liquid (i.e. the hydraulic oil 64) introduced in the cylinder 26. The liquid reservoir 72 is normally filled with air of the atmospheric pressure. When the internal pressure of the cylinder 26 rises in excess of the predetermined threshold value, the safety valve 71 opens, through which the thermally expanded high-pressure hydraulic oil 64 in the cylinder 26 flows into the liquid reservoir 72 to decrease the pressure in the cylinder 26. The safety valve 71 closes when the pressure on the cylinder 26 goes down below the threshold value. The reservoir 72 needs to be about two to three times as large as the amount of thermal expansion of the liquid. The internal pressure of the reservoir 72 is also somewhat raised (2 to 3 atm) by the flowing thereinto of the hydraulic oil 64, but it is smaller than the operating pressure (600 atm, for example) of the safety valve 71, and hence does not matter in particular.

A fourth feature of Embodiment 5 resides in the stroke adjustment means 80 which maintains the pressure on the cable holder 24 substantially constant regardless of an increase in the internal pressure of the cylinder 26.

Figure 8A:
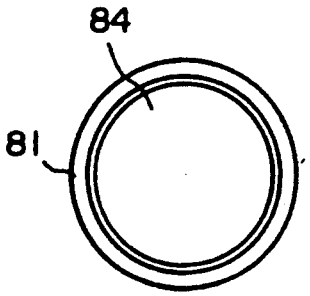
FIGS. 8A and 8B is a front view and a side view illustrating stroke adjustment means employed in the present invention.
Figure 8B:
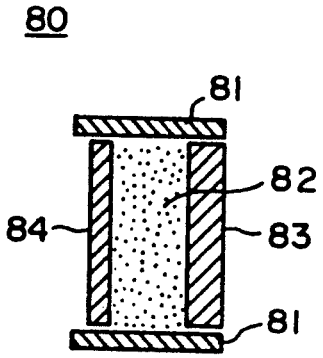

FIG. 8(a) is a front view of the stroke adjustment means 80 and FIG. 8(B) its side view. Reference numeral 81 denotes a metal ring made of iron or the like, 82 a buffer which is deformed when a pressure is produced in excess of a predetermined value, and 83 and 84 disks made of iron or the like. These elements make up the stroke adjustment means 80. The buffer 82 is, for example, lead which is deformed by a pressure of four tons or more.

Now, the operation of the stroke adjustment means 80 will be described. The internal pressure of the cylinder 26 increases with a temperature rise or the like, and consequently, the piston rod 28 is urged forward, applying pressure on the buffer 82, the metal disk 83 and the cable holder 24 through the metal disk 84. When the pressure by the piston rod 28 exceeds a predetermined threshold value, the buffer 82 is deformed and the metal ring 81 is subject to a force acting thereon in a direction from its inside to the outside thereof, that is, in a direction in which to increase its diameter. When the mechanical strength of the metal ring 81 reaches its limit, it breaks up, permitting free deformation of the buffer 82. In this case, since the piston rod 28 moves forward in correspondence to the amount of deformation of the buffer 82, the amount of compression of the hydraulic oil 64 in the cylinder 28 decreases, thus maintaining the internal pressure of the cylinder 28 at an essentially constant value. Incidentally, the disks 83 and 84 need not always be provided; namely, the pressure of the piston rod 28 may also be applied directly on the buffer 82. Furthermore, equally-spaced-apart thin grooves may also be cut in the metal ring 81 in the lengthwise direction thereof (i.e. in a direction perpendicular to its circumference) so as to adjust its mechanical strength.

In general, the relationship between the stroke adjustment means 80 and the cylinder internal pressure controller 70 is set so that the latter operates before the former functions.

EMBODIMENT 6

Figure 9A:
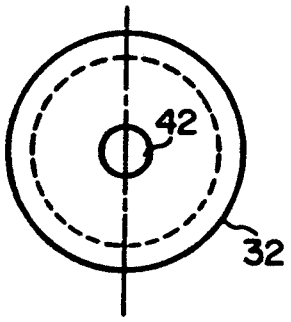
FIGS. 9A and 9B are a plan view and a side view of a check value illustrating as a sixth embodiment of the present invention.
Figure 9B:
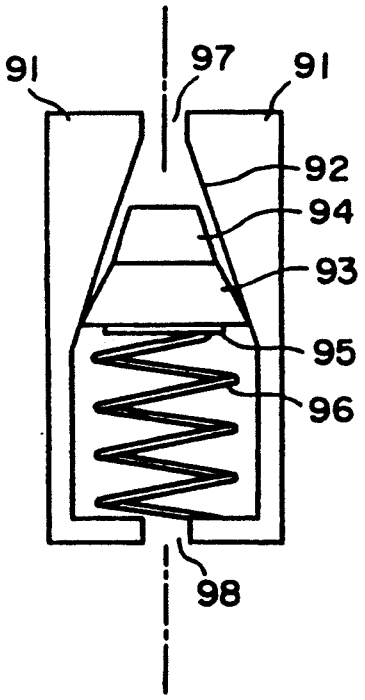

FIGS. 9A and 9B are a plan view and a side view schematically illustrating a sixth embodiment of the present invention, which is the check valve 34 for use in the embodiment shown in FIG. 7. The check valve 34 is composed principally of a metal tube 91 having its inside partly formed in a conical form as indicated by 92, a rubber or elastic plug 93 fitted into the conical portion 92 of the metal rube 91, a plug 94 of a hard material also fitted into the conical portion 92 of the metal tube 91, a washer 95 and a spring 96. The metal tube 91 has an outlet port 97 and an inlet port 98. The check valve 34 is mounted on the grappling unit 42 with the outlet port 97 disposed on the side of the hydraulic oil tank 62 (now shown in FIG. 9) and the inlet port 98 on the side of the cylinder 26 (now shown in FIG. 9, either).

Letting the angle of inclination of the interior surface of the metal tube 91, the angle of inclination of the hard plug 94 and the angle of inclination of the elastic plug 93 be represented by $\alpha$, $\theta_1$ and $\theta_2$, they are formed as to satisfy the condition $\alpha<\theta<\theta$.

In FIG. 9, when the hydraulic oil 94 flows into the metal tube 91 through the input port 98 owing to the seawater pressure at the bottom of the sea, the elastic plug 93 and the hard-material plug 94 are pressurized by the water pressure. As a result of this, the spring 96 is compressed to form an air gap between the elastic plug 93 and the interior surface 92 of the conical portion of the metal tube 91 and the hydraulic oil 94 flows into the cylinder 26 through the air gap and the inlet port 98. When the pressure in the cylinder 26 approaches the water pressure at the bottom of the sea, the spring 96 returns to its initial state and the air gap between the elastic plug 93 and the interior surface 92 of the conical portion of the metal tube 91 is completely closed, based on the above-mentioned condition $\alpha<\theta_1<\theta_2$.

As the submarine cable grapnel 40 is winched up, the water pressure at the outlet port 97 gradually decreases and a difference between it and the internal pressure of the cylinder 26 also increases very slowly, but the soft elastic plug 93 ensures preventing the seawater in the cylinder 26 from flowing out therefrom.

When the grapnel is brought up to the vicinity of the surface of the sea, the difference between the internal pressure of the cylinder 26 and the external seawater pressure is 500 kg/cm$^2$ or more. Even in the presence of such a large pressure difference, however, the elastic plug 93 presses the hard plug 94 by the internal pressure of the cylinder 26 to stop a gap between the plug 94 and the interior surface 92 of the conical portion of the metal tube 91; thus, the hard plug 94 and the elastic plug 93 cooperate with each other to prevent the hydraulic oil 64 from flowing out of the cylinder 26 and hence prevent dropping of the internal pressure of the cylinder 26.

Incidentally, the metal tube 91 is made of steel and the hard plug 94 is made of the same material as that for the metal tube 91 or aluminum (Al), copper (Cu), lead (Pb), or hard plastics.

It is also possible to employ a construction in which a shaft is provided in addition to the spring 96 and is bonded to the elastic plug 93 with an adhesive so that the hard plug 94 and the elastic plug 93 both move up and down completely vertically.

EMBODIMENT 7

FIG. 10 is a circuit diagram of a grapnel signal system of the submarine cable grapnel for use in the above-described embodiments. The grapnel signal system, indicated generally by 100, is comprised principally of a monitor 101 on the cable ship, a signal line 102 incorporated in the tow rope 20, the attitude sensor 62 mounted on an attitude stabilizer 103 or the grappling unit 42, and the grappling sensor 64 mounted on the grappling unit 42.

The grappling sensor 64 includes a switch $S_2$ which is turned ON when the cable 23 is grappled and a resistor $R_2$ connected in series to the switch $S_2$. The attitude sensor 62 includes a switch $S_1$ which is in the ON or OFF state, depending on whether the attitude of the grappling unit 42 is normal or abnormal, and a resistor $R_1$ connected in series to the switch $S_1$. The switch $S_1$ is, for example, a switch of the type that contacts and mercury are sealed in a cylindrical glass capsule as shown in FIG. 5. By fixing the capsule and the attitude stabilizer 103 relative to each other, the mercury moves in the direction of gravity; that is, when the grappling unit 42 is in the normal attitude, the contacts are interconnected via the mercury, and when the grappling unit 42 is in the abnormal attitude, the mercury is apart from the contacts and the contacts are not connected to each other. Incidentally, the resistance value of the signal line 102 in two ways is represented by $R_0$.

Since a resistor $R_3$ may preferably by connected as indicated by the broken line in FIG. 10, a description will be given of an example including the resistor $R_3$.

Table 1 shows the ON/OFF state of each sensor switch and resistance values $R_A$, $R_B$, $R_C$ and $R_D$ of the signal system monitored on the cable ship, corresponding to each of operative states of the submarine cable grapnel, A (in normal attitude, cable grappled), B (in normal attitude, cable ungrappled), C (in upside-down attitude, cable grappled) and D (in upside-down attitude, cable ungrappled). Assuming, for example, that the resistance values $R_0$, $R_1$, $R_2$ and $R_3$ are 1, 25, 12.5 and 50 KΩ, respectively, the resistance values $R_A$, $R_B$, $R_C$ and $R_D$ of the signal system are 8.1, 17.6, 11.0 and 51 KΩ, respectively; accordingly, the state of operation of the cable grapnel can be identified on the cable ship.

TABLE 1

| | Attitude of Stabilizer | Cable Grappled/ Ungrappled | $S_1$ | $S_2$ | Resistance values Monitored on Cable Ship | Examples of Resistance Values (KΩ)* |
|---|---|---|---|---|---|---|
| A | Normal | Grappled | ON | ON | $R_0 + \frac{R_1R_2R_3}{R_1R_2 + R_2R_3 + R_3R_1}$ | $= R_A$ (8.1) |
| B | | Ungrappled | | OFF | $R_0 + \frac{R_1R_3}{R_1 + R_3}$ | $= R_B$ (17.6) |
| C | Upside-Down | Grappled | OFF | ON | $R_0 + \frac{R_2R_3}{R_2 + R_3}$ | $= R_C$ (11.0) |
| D | | Ungrappled | | OFF | $R_0 + R_3$ | $= R_D$ (51.0) |

In the practical use of the submarine cable grapnel, the attitude sensor 103 is put in the state D on the cable ship to make sure that the resistance value is $R_D$, this indicating the normal connection of the signal line of the signal system. During the descent of the cable grapnel to the bottom of the sea the resistance value $R_B$ or $R_D$ corresponding to the state B or D is monitored. When the cable grapnel 40 assumes its normal attitude with the chain 22 dragged on the seabed as shown in FIG. 3, the resistance value $R_B$ corresponding to the state B is monitored. In a case where the resistance value $R_B$ is still observed after the tow rope 20 has been paid out sufficiently until the attitude stabilizer 44 reaches the seabed, it is indicated that the grapnel has reached the seabed in the normal posture, and then the dragging of the cable grapnel is started. When the cable 23 is grappled, the resistance value $R_A$ corresponding to the start A is obtained; so that the tow rope 20 is winched up onto the cable ship to recover the cable grapnel and the failing cable. Where it cannot be made sure that the cable grapnel has reached the seabed in the normal attitude, the two rope 20 is winched up until the grappling unit 42 or rear attitude stabilizer 47 lifts off the bottom of the sea, and then the grapnel landing operation is carried out again.

As mentioned above, the resistor $R_3$ in FIG. 10 may also be omitted, and also in this case, there is no problem in monitoring the operating state of the cable grapnel.

EMBODIMENT 8

FIG. 11 is a circuit diagram illustrating the grapnel signal system according to an eighth embodiment of the present invention. The signal system, indicated generally by 100, is composed mainly of a monitor 72 on the cable ship, a signal line 112, and attitude sensor 113 and a grappling sensor 114. The signal system of this embodiment is essentially identical in construction with the system shown in FIG. 10 except in that the switch $S_1$ ($S_2$) is connected in parallel to a resistor $R_{11}$ ($R_{12}$). The monitor 72 includes a constant-current source 73 and a voltmeter 74.

In this embodiment the switches $S_1$ and $S_2$ operate in the same manner as in the FIG. 10 embodiment, but the expressions for calculating the resistance values, which are monitored on the cable ship, differ from the expressions used in the FIG. 10 embodiment as shown in Table 2.

The resistors $R_{11}$ and $R_{12}$ in this embodiment may be formed by diodes or similar nonlinear resistance elements.

TABLE 2

| | Attitude of Stabilizer | Cable Grappled/ Ungrappled | $S_1$ | $S_2$ | Resistance Values (KΩ) Monitored on the Cable Ship* | Voltage (V) on Voltmeter on Cable Ship* |
|---|---|---|---|---|---|---|
| A | Normal | Grappled | ON | ON | $R_0 = 1$ | 1 |
| B | | Ungrappled | | OFF | $R_0 + R_{12} = 21$ | 21 |
| C | Upside-Down | Grappled | OFF | ON | $R_0 + R_{11} = 11$ | 11 |
| D | | Ungrappled | | OFF | $R_0 + R_{11} + R_{12} = 31$ | 31 |

*$R_0$: 1 KΩ, $R_{11}$: 10 KΩ, $R_{12}$: 20 KΩ
Constant-Current Source (73): 1 mA
Voltmeter (74): Assumed to have a very high internal resistance (1) According to the present invention, the number of grappling units used (four in the prior art) can be reduced to one, and consequently, the grapnel is less expensive accordingly. Further, maintenance and repair work of the grappling unit can be reduced to ¼ that needed in the past; this remarkably improves the maintenance and repair work in terms of cost and efficiency.

(2) With the provision of the attitude sensor, it is possible to surely check, on the cable ship, the attitude of the grapnel on the bottom of the sea.

(3) With the provision of the pedestals, the stone remover and the grappling hook, it is possible to prevent that earth and soil from the dragging of the cable grapnel enter into the cable holding and cutting part 45 of the grappling unit 42 to make the cable holding and cutting operation unstable.

(4) With the construction that the liquid 64 flows into the cylinder 26 from the tank 62, no mud or sand in the seawater flows into the cylinder, and hence the grapnel is highly reliable and easy of maintenance.

(5) Since the piston rod 28 extends through the cylinder 28, there is no influence of the decrease in the external pressure on the cylinder which is caused by the recovery of the grapnel onto the cable ship, and hence the piston rod 28 is not pushed forward by the decrease in the external water pressure; therefore, the cable grappled by the grapnel is not crushed or damaged.

(6) By the cylinder internal pressure control means 70 or the stroke adjustment means 80, the internal pressure of the cylinder 28 can be held substantially constant regardless of a temperature rise of the hydraulic oil 64 in the cylinder 28 which is caused by a temperature rise around the grappling unit 42.

Thus, the present invention is of great utility when applied to a grapnel which grapples a pipe, submarine cable or the like laid on the bottom of the sea and cut and holds it.

What we claim is:

1. A submarine cable grapnel for grappling a submarine cable laid on the bottom of the sea comprising:

a grappling unit for grappling said submarine cable; grappling means comprising said grappling unit and an attitude stabilizer coupled to said grappling unit;

a tow line connected to a front end of said grappling means; said grappling means having front and rear coupling portions disposed at ends thereof such that centers of gravity of said grappling unit and of said attitude stabilizer lie below a line joining respective coupling centers of said coupling portions when said grappling means is drawn by the tow line in the sea and lands on the bottom of the sea in an operative attitude for grappling said cable so that said grappling unit intersects said cable; and back-tension loading means connected to a rear end of said grappling means.

2. A submarine cable grapnel according to claim 1, in which said stabilizer and said grappling unit are a unitary structure, and said grappling unit is disposed on an underside of said stabilizer.

3. A submarine cable grapnel according to claim 1, in which said grappling unit has a grappling hook on an underside thereof.

4. A submarine cable grapnel comprising:

a grappling unit; grappling means comprising said grappling unit and a stabilizer coupled to said grappling unit;

a tow line connected to a front end of said grappling means; said grappling unit and said stabilizer having front and rear coupling portions disposed thereon such that centers of gravity of said grappling unit and of said stabilizer lie below a line joining respective coupling centers of said coupling portions when said grapnel lands on the bottom of the sea in an operative attitude for grappling said cable;

back-tension loading means connected to a rear end of said grappling means;

a sensing switch mounted on said grappling means activated to an ON condition when said grapnel lands in said operative altitude and assumes an OFF condition when said grapnel lands in an attitude in which it is not positioned in an operative attitude for effecting grappling of said cable, and means for transmitting an electrical output signal under control of said switch to a tow ship towing said grapnel.

5. A submarine cable grapnel according to claim 4, in which said switch is mounted on said stabilizer.

6. A submarine cable grapnel according to claim 4, in which said switch is mounted on said grappling unit.

7. A submarine cable grapnel comprising:

a grappling unit; grappling means comprising said grappling unit and a stabilizer coupled to said grappling unit;

a tow line connected to a front end of said grappling means; said grappling unit and said stabilizer having front and rear coupling portions disposed thereon such that centers of gravity of said grappling unit and of said stabilizer lie below a line joining respective coupling centers of said coupling portions when said grapnel lands on the bottom of the sea in an operative attitude for grappling said cable;

back-tension loading means connected to a rear end of said grappling means;

said grappling unit and said stabilizer each comprising a pedestal on an underside thereof, and said stabilizer having a stone remover on an underside thereof and which has a height the same as said grappling hook.

8. A submarine cable grapnel according to claim 7, in which said grappling hook and said stone remover have a width of about 1.5 cm.

9. A submarine cable grapnel comprising:

a grappling unit; grappling means comprising said grappling unit and a stabilizer coupled to said grappling unit;

a tow line connected to a front end of said grappling means; said grappling unit and said stabilizer having front and rear coupling portions disposed thereon such that centers of gravity of said grappling unit and of said stabilizer lie below a line joining respective coupling centers of said coupling portions when said grapnel lands on the bottom of the sea in an operative attitude for grappling said cable;

back-tension loading means connected to a rear end of said grappling means;

said stabilizer and said grappling unit each having a pedestal on an underside thereof, said grappling unit comprising a grappling hook, and said stabilizer being connected to said tow line forwardly of said grappling unit and having a stone remover.

10. A submarine cable grapnel comprising:

a grappling unit; grappling means comprising said grappling unit and a stabilizer coupled to said grappling unit;

a tow line connected to a front end of said grappling means; and said grappling unit and rear coupling portions disposed thereon such that centers of gravity of said grappling unit and of said stabilizer lie below a line joining respective coupling centers of said coupling portions when said grapnel lands on the bottom of the sea in an operative attitude for grappling said cable said grappling unit and said stabilizer each having a respective pedestal on an underside thereof said grappling unit having a thin grappling hook; the height of said thin grappling hook relative to the pedestal thereof being 1.5 to 2.5 times large than the maximum diameter of a submarine cable to be grappled; said attitude stabilizer being connected between the tow line and the grappling unit and having a stone remover on an underside thereof; said stone remover having a same height as that of said grappling hook; and back-tension loading means connected to a rear end of said grappling means.

11. A submarine cable grapnel according to claim 10, in which said grappling hook, and said stone remover each have a width of about 1.5 cm.

12. A submarine cable grapnel comprising:

a grappling unit;

grappling means comprising said grappling unit and a stabilizer coupled to said grappling unit;

a tow line connected to a front end of said grappling means: said grappling unit and said stabilizer having front and rear coupling portions disposed thereon such that centers of gravity of said grappling unit and of said stabilizer lie below a line joining respective coupling centers of said coupling portions when said grapnel lands on the bottom of the sea in an operative attitude for grappling said cable; said grappling unit having a deformable container for containing therein a hydraulic fluid; a cylinder into which said hydraulic fluid flows when said container deforms in response to external sea pressure; a piston reciprocal in said cylinder in response to hydraulic fluid flow into said cylinder, a check valve for preventing counterflow of hydraulic fluid from said cylinder; cable holding and cutting means coupled to said piston for cutting the cable and holding severed ends thereof under control of internal hydraulic fluid pressure in the cylinder; a cylinder pressure controller for compensating thermal expansion of said hydraulic fluid in said cylinder and a grappling hook for grappling a submarine cable and guiding it to said cable holding and cutting means; and back-tension loading means connected to a rear end of said grappling means.

13. A submarine cable grapnel according to claim 12, in which said check valve comprises a metal tube having an inlet and outlet port, the tube having an internal conical portion, a conical plug, received in said conical portion, said plug being formed of an elastic material and a hard material, and a spring mechanism urging said plug into said conical position of said metal tube.

14. A submarine cable grapnel comprising:

a grappling unit;

grappling means comprising said grappling unit and a stablizier coupled to said grappling unit;

a tow line connected to a front end of said grappling means; said grappling unit and said stabilizer having front and rear coupling portions disposed thereon such that centers of gravity of said grappling unit and of said stabilizer lie below a line joining respective coupling centers of said coupling portions when said grapnel lands on the bottom of the sea in an operative attitude for grappling said cable;

a grappling sensor on said grappling means for developing an electrical signal for indicating when a cable has been grappled; an attitude sensor on said grappling means for developing an electrical signal for indicating that the grappling means is in an operative attitude for grappling said submarine cable; means for transmitting each signal for monitoring states of operation of said grappling means, and back-tension loading means connected to a rear end of said grappling means.

15. A submarine cable grapnel according to claim 14, in which said means for transmitting each signal comprises circuitry for transmitting electrical signals via said tow line to a tow ship towing the grapnel, and said circuitry comprises means for developing the signals at different operational stages and states of said grapnel for monitoring thereof.

* * * * *